US011783750B2

(12) United States Patent
Choi et al.

(10) Patent No.: US 11,783,750 B2
(45) Date of Patent: Oct. 10, 2023

(54) LOCALLY DIFFERENT GAMMA MAPPING FOR MULTI-PIXEL DENSITY OLED DISPLAY

(71) Applicant: Google LLC, Mountain View, CA (US)

(72) Inventors: Sangmoo Choi, Palo Alto, CA (US); Janghoon Song, Seoul (KR); Taesung Kim, Sunnyvale, CA (US)

(73) Assignee: Google LLC, Mountain View, CA (US)

( * ) Notice: Subject to any disclaimer, the term of this patent is extended or adjusted under 35 U.S.C. 154(b) by 243 days.

(21) Appl. No.: 17/260,871

(22) PCT Filed: Jul. 29, 2020

(86) PCT No.: PCT/US2020/043951
§ 371 (c)(1),
(2) Date: Jan. 15, 2021

(87) PCT Pub. No.: WO2021/030054
PCT Pub. Date: Feb. 18, 2021

(65) Prior Publication Data

US 2022/0309983 A1 Sep. 29, 2022

Related U.S. Application Data

(60) Provisional application No. 62/949,657, filed on Dec. 18, 2019, provisional application No. 62/885,895, filed on Aug. 13, 2019.

(51) Int. Cl.
*G09G 3/20* (2006.01)
*G09G 3/3208* (2016.01)

(52) U.S. Cl.
CPC ..... *G09G 3/2007* (2013.01); *G09G 3/3208* (2013.01); *G09G 2320/0233* (2013.01);
(Continued)

(58) Field of Classification Search
CPC ..... G09G 3/2007; G09G 3/3208; G09G 2320/0233; G09G 2320/0276;
(Continued)

(56) References Cited

U.S. PATENT DOCUMENTS 10,360,856 B2 * 7/2019 Oh ..... G09G 3/2007
10,852,866 B2 * 12/2020 Park ..... G06F 3/14
(Continued)

FOREIGN PATENT DOCUMENTS

CN 103531175 10/2013
CN 208924293 11/2018
(Continued)

OTHER PUBLICATIONS

PCT International Preliminary Report on Patentability in International Appln. PCT/US2020/043951, dated Feb. 24, 2022, 16 pages.
(Continued)

*Primary Examiner* — Vijay Shankar
(74) *Attorney, Agent, or Firm* — Fish & Richardson P.C.

(57) ABSTRACT

A method for driving an organic light emitting diode (OLED) display having a first area with a first pixel density and a second area with a second pixel density higher than the first pixel density, the method includes receiving image content that specifies a grayscale value for both a first pixel in the first area and a second pixel in the second area, providing, based on the grayscale value, a first voltage to the first pixel in the first area, and providing, based on the grayscale value, a second voltage that is different from the first voltage to the second pixel in the second area, where the second voltage causes the second pixel to emit light less brightly than the first voltage causes the first pixel to emit light.

17 Claims, 6 Drawing Sheets

(52) U.S. Cl.
CPC ..... *G09G 2320/0276* (2013.01); *G09G 2320/0673* (2013.01); *G09G 2320/0686* (2013.01)

(58) Field of Classification Search
CPC ... G09G 2320/0673; G09G 2320/0686; G09G 3/3275; G09G 2310/0221; G09G 2320/0626; G09G 3/3291
See application file for complete search history.

(56) References Cited

U.S. PATENT DOCUMENTS

| | | | | |
|---|---|---|---|---|
| 11,120,726 | B2 * | 9/2021 | Zhao | G09G 3/2003 |
| 11,410,613 | B2 * | 8/2022 | Lee | G09G 3/3266 |
| 2003/0030613 | A1 | 2/2003 | Granada et al. | |
| 2014/0368531 | A1 | 12/2014 | Small | |
| 2018/0129328 | A1 * | 5/2018 | Park | G06F 3/0416 |
| 2018/0164749 | A1 | 6/2018 | Yuen | |
| 2020/0111401 | A1 * | 4/2020 | Zhao | G09G 3/2003 |
| 2020/0152134 | A1 | 5/2020 | Lee et al. | |

FOREIGN PATENT DOCUMENTS

| | | |
|---|---|---|
| CN | 110047897 | 7/2019 |
| EP | 3242286 | 11/2017 |

OTHER PUBLICATIONS

PCT International Search Report and Written Opinion in International Appln. No. PCT/US2020/043951, dated Nov. 11, 2020, 24 pages.

* cited by examiner

LOCALLY DIFFERENT GAMMA MAPPING FOR MULTI-PIXEL DENSITY OLED DISPLAY

CROSS-REFERENCE TO RELATED APPLICATION

This application is a National Stage Application under 35 U.S.C. § 371 and claims the benefit of International Application No. PCT/US2020/043951, filed on Jul. 29, 2020, which claims priority to U.S. Provisional Application Ser. No. 62/949,657, filed on Dec. 18, 2019 and 62/885,895, filed on Aug. 13, 2019. The disclosure of the prior application is considered part of and is incorporated by reference in the disclosure of this application.

BACKGROUND

Electronic devices include displays that can change in brightness.

SUMMARY

This specification describes techniques, methods, systems, and other mechanisms for locally different gamma mapping for multi-pixel density organic light-emitting diode (OLED) displays. Gamma mapping may change gamma values of pixels in images to compensate for various luminance effect of displays. For example, gamma mapping may include gamma correction to account for non-linear human perceptive bias of brightness, i.e., humans being more sensitive to changes in brightness at low levels than at high ones.

An OLED display that has areas with different pixel densities across the display may vary in brightness. For example, a first area of the display may have pixels that are a similar size to a second area of the display but only have half the number of pixels per unit area in comparison to the second area. Accordingly, if the two areas of the display are both showing a completely white image, the first area may appear dimmer than the second area as fewer pixels per unit area in the first area may emit light compared to the second area.

In order to keep luminance of the lower pixel density region similar to the higher pixel density region, the luminance of each pixel in the lower pixel density region may be increased. For example, each of the pixels in the lower pixel density region may be made to be twice as bright as each pixel in the higher pixel density region.

Increasing the brightness of each pixel may be done through gamma mapping based on whether the pixels are in the first area or the second area. For example, image content may be provided for display where a pixel in the first area and a pixel in the second area may both have a same digital grayscale value of G255 (the highest gray level in 8-bit grayscale), a pixel data voltage, $V_{DATA}$, of 1.5 volts (V) may then be provided to the pixel in the first area, and a voltage of 2.5 V may then be provided to the pixel in the second area, where providing a voltage of 1.5 V to pixels may result in the pixels emitting light brighter than providing a voltage of 2.5 V to the pixels due to p-channel transistor behavior in the pixel circuit.

Accordingly, locally different gamma mapping for multi-pixel density OLED displays may enable multi-pixel density OLED displays to have a uniform luminance even between areas of the OLED displays that have different pixel densities. Having a uniform luminance may hide the difference in pixel density of areas of the display from viewers and users may not even realize the display has areas with different pixel densities from a distance.

Additionally, in some implementations, matching luminance between areas of the OLED displays that have different pixel densities may limit a maximum luminance of the displays. For example, at high display brightness settings a maximum brightness of pixels in the lower pixel density region may be insufficient to produce an overall luminance in the lower pixel density region that matches the luminance that could otherwise be produced in the higher pixel density region. Accordingly, the brightness of the pixels in the different pixel density areas may be further adaptively adjusted based on display brightness settings to increase a maximum luminance of the displays.

In general, one innovative aspect of the subject matter described in this specification can be embodied in a method for driving an organic light emitting diode (OLED) display having a first area with a first pixel density and a second area with a second pixel density higher than the first pixel density, the method including receiving image content that specifies a grayscale value for both a first pixel in the first area and a second pixel in the second area, providing, based on the grayscale value, a first voltage to the first pixel in the first area, and providing, based on the grayscale value, a second voltage that is different from the first voltage to the second pixel in the second area, where the second voltage causes the second pixel to emit light less brightly than the first voltage causes the first pixel to emit light.

Other embodiments of this aspect include corresponding circuitry, computer systems, apparatus, and computer programs recorded on one or more computer storage devices, each configured to perform the actions of the methods. A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

These and other embodiments can each optionally include one or more of the following features. In some aspects, providing, based on the grayscale value, a second voltage that is different from the first voltage to the second pixel in the second area includes determining a remapped grayscale value for the second pixel based on the value and providing the second voltage based on the remapped grayscale value. In certain aspects, determining a remapped grayscale value for the second pixel based on the grayscale value includes determining that a location of the second pixel is within the second area and in response to determining that the location of the second pixel is within the second area, determining the remapped value for the second pixel based on the grayscale value and a lookup table for the second area.

In some implementations, providing, based on the grayscale value, a first voltage to the first pixel in the first area includes determining that a location of the first pixel is within the first area and in response to determining that the location of the first pixel is within the first area, determining a remapped grayscale value for the first pixel based on the grayscale value and a lookup table for the first area. In certain aspects, providing the second voltage based on the remapped grayscale value includes providing the remapped grayscale value to a driver integrated circuit and providing, by the driver integrated circuit, the second voltage to the second pixel, where the driver integrated circuit is configured to output voltages in response to grayscale values that are input irrespective of locations of pixels that are driven by the voltages output.

In some aspects, the number of digital bits for the remapped grayscale value is higher than or equal to grayscale bit numbers for the grayscale value. In some implementations, providing, based on the grayscale value, a second voltage that is different from the first voltage to the second pixel in the second area includes receiving, by a driver integrated circuit, the grayscale value for the second pixel and providing, by the driver integrated circuit to the second pixel, the second voltage based on both the grayscale value and the second pixel being in the second area. In some aspects, providing, based on the grayscale value, a first voltage to the first pixel in the first area includes receiving, by the driver integrated circuit, the grayscale value for the first pixel and providing, by the driver integrated circuit to the first pixel, the first voltage based on both the grayscale value and the first pixel being in the first area.

In certain aspects, providing, based on the grayscale value, a first voltage to the first pixel in the first area includes providing the first voltage to the first pixel in the first area where the first voltage results in the first area having a unit area brightness that is less than a unit area brightness of the second area and a brightness setting for the display satisfies a criteria. In some aspects, actions include receiving second image content that also specifies the grayscale value for the first pixel in the first area and providing a third voltage that is different than the first voltage to the first pixel in the first area and the brightness setting for the display does not satisfy the criteria.

In some implementations, providing, based on the grayscale value, a first voltage to the first pixel in the first area includes providing the first voltage to the first pixel in the first area where the first voltage results in the first area having a unit area brightness that is similar to a unit area brightness of the second area and a brightness setting for the display does not satisfy a criteria.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
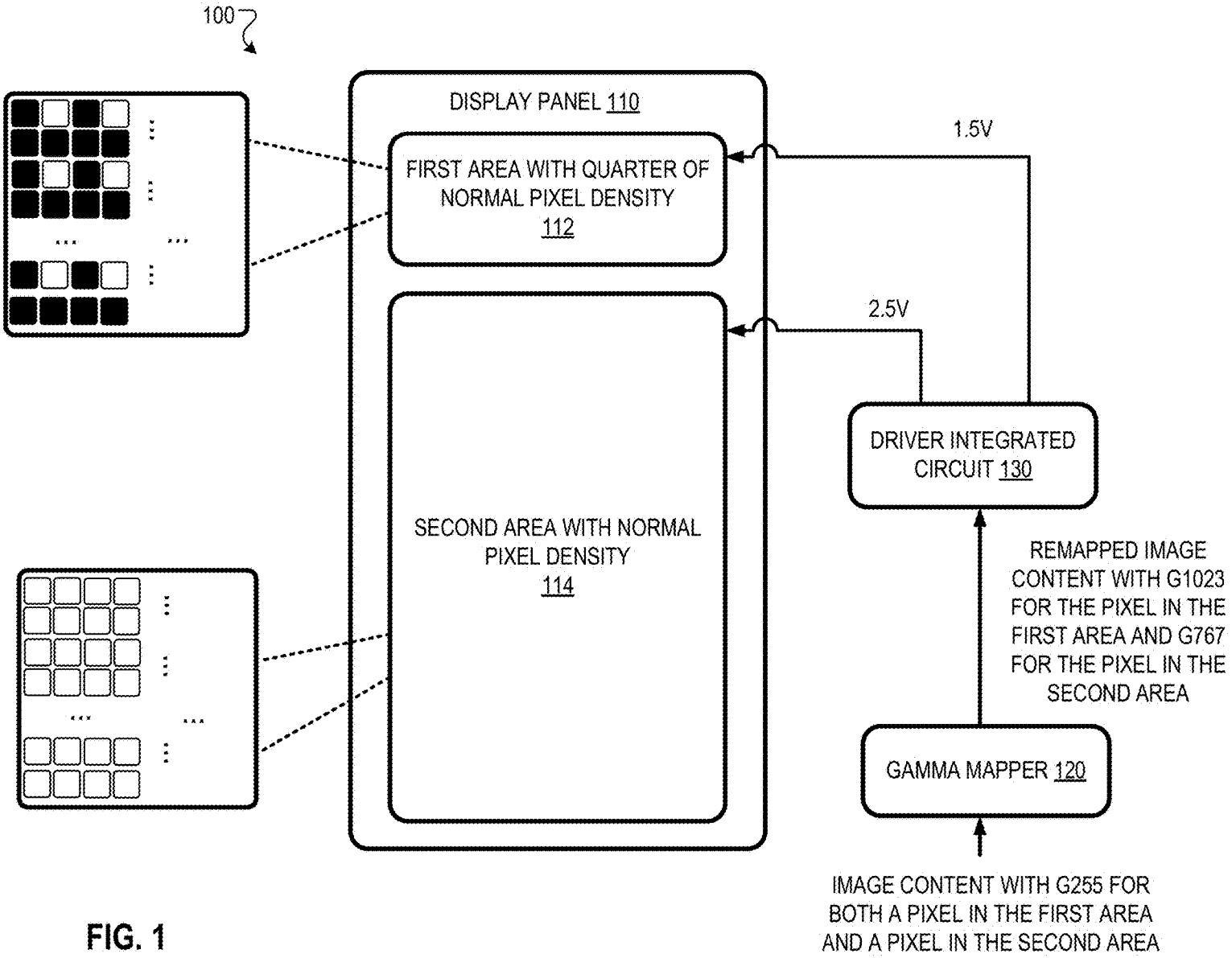
FIG. 1 is a block diagram of an example system that includes a multi-pixel density OLED display using locally different gamma mapping.

FIG. 1 is a block diagram of an example system 100 that includes a multi-pixel density OLED display panel 110 using locally different gamma mapping. The system 100 also includes a gamma mapper 120 that performs locally different gamma mapping on image content to generate remapped image content, and includes a driver integrated circuit 130 that receives the remapped image content and outputs voltages to the display panel 110 based on the remapped image content.

The display panel 110 includes a first area 112 and a second area 114, where the first area 112 includes a pixel density that is lower than a pixel density of the second area 114. For example, as shown in FIG. 1, the first area 112 and the second area 114 may include pixels that have the same sizes between the areas, but the first area 112 may have a lower pixel density than the second area 114 as a pattern of pixels in the first area 112 may correspond to the pattern of the pixels in the second area 114 where three out of four pixels in the pattern of the pixels in the second area is missing, in other words, the first area 112 has a quarter pixels per unit area (a quarter pixel density) of the second area 114.

The pixels in the display panel 110 may be configured to emit light at different brightness based on voltages received by the pixels. For example, each of the pixels in the display panel 110 may be configured to emit light at a first brightness in response to receiving 2.5 V and emit light at four times the first brightness in response to receiving 1.5 V.

The gamma mapper 120 may receive image content to be shown on the display panel 110 and generate remapped image content based on image content. For example, the gamma mapper 120 may receive image content with a grayscale value of G255 for both a pixel in the first area 112 and a pixel in the second area 114 and, in response, generate remapped image content with a grayscale value of G1023 for the pixel in the first area and G767 for the pixel in the second area.

The gamma mapper 120 may generate remapped image content based on locally different gamma mapping. For example, the gamma mapper 120 may map the grayscale value of G255 to G1023 for all pixels in the first area 112 and map the grayscale value of G255 to G767 for all pixels in the second area 114. In another example, the gamma mapper 120 may the grayscale value of G127 to G511 for all pixels in the first area 112 and map the grayscale value of G127 to G383 for all pixels in the second area 114.

The gamma mapper 120 may generate the remapped image content based on remapping a value for each pixel based on the location of the pixel in the display panel. The gamma mapper 120 may receive a digital grayscale value for a pixel, determine which area that the pixel is located, and then remap the grayscale value for the pixel based on a remapping range for the corresponding area.

For example, the gamma mapper 120 may determine that pixel data in an image is to be displayed in the first area 112 of the display panel 110, in response, obtain a lookup table for the first area 112 that maps grayscale values from a first range of 0-255 to a second range of 0-1023. In another example, the gamma mapper 120 may determine that a pixel data in an image is to be displayed in the second area 114 of the display panel 110, in response, obtain a lookup table for the second area 114 that maps grayscale values from a first range of 0-255 to a third range of 0-767. The lookup table may include rows for each grayscale value in the first range of 0-255 and, for each row, a corresponding remapped grayscale value.

In some implementations, the gamma mapper 120 may remap image content through circuitry. For example, the gamma mapper 120 may be implemented entirely in hardware circuitry that receives grayscale values for pixels and outputs remapped grayscale values differently based on the locations of the pixels in the display panel 110, where the circuitry is arranged based on which pixels are located in which of the first area 112 and the second area 114. In another implementation, the gamma mapper 120 may be implemented by software and use a formula that receives a grayscale value for a pixel and a location of the pixel as a paired input, and outputs a remapped grayscale value for the pixel as output. In yet other implementations, the gamma mapper 120 may be implemented by software and use the lookup tables as described above. In still another implementations, the gamma mapper 120 may be implemented by a combination of circuitry and software.

The driver integrated circuit 130 may be circuitry that is configured to provide voltage signals to pixels in a display panel 110 based on digital grayscale values received from a gamma mapper 120 for the pixels. For example, the driver integrated circuit 130 may be configured to provide a voltage of 2.5 V in response to receiving a grayscale value of G767 and a voltage of 1.5 V in response to receiving a grayscale value of G1023. The driver integrated circuit 130 may receive other control factors that affect the final output voltage signal level of a same grayscale data for a pixel, such as display brightness control, display uniformity calibration, color calibration, and pattern loading effect control.

While FIG. 1 shows a display with two areas with different pixel density, the gamma mapper 120 may similarly remap image content for a display panel with three, four, or more areas with different pixel densities based on providing drive signals with different pulse widths to the corresponding areas. For example, the gamma mapper 120 may include a map that defines which of four areas that each pixel is within, for each area, a lookup table for remapping grayscale values for the area, and then remap image content based on determining which of the four areas each pixel in the image content corresponds based on the map and then applying the lookup table for the determined area to the grayscale values to obtain remapped grayscale values.

Figure 2:
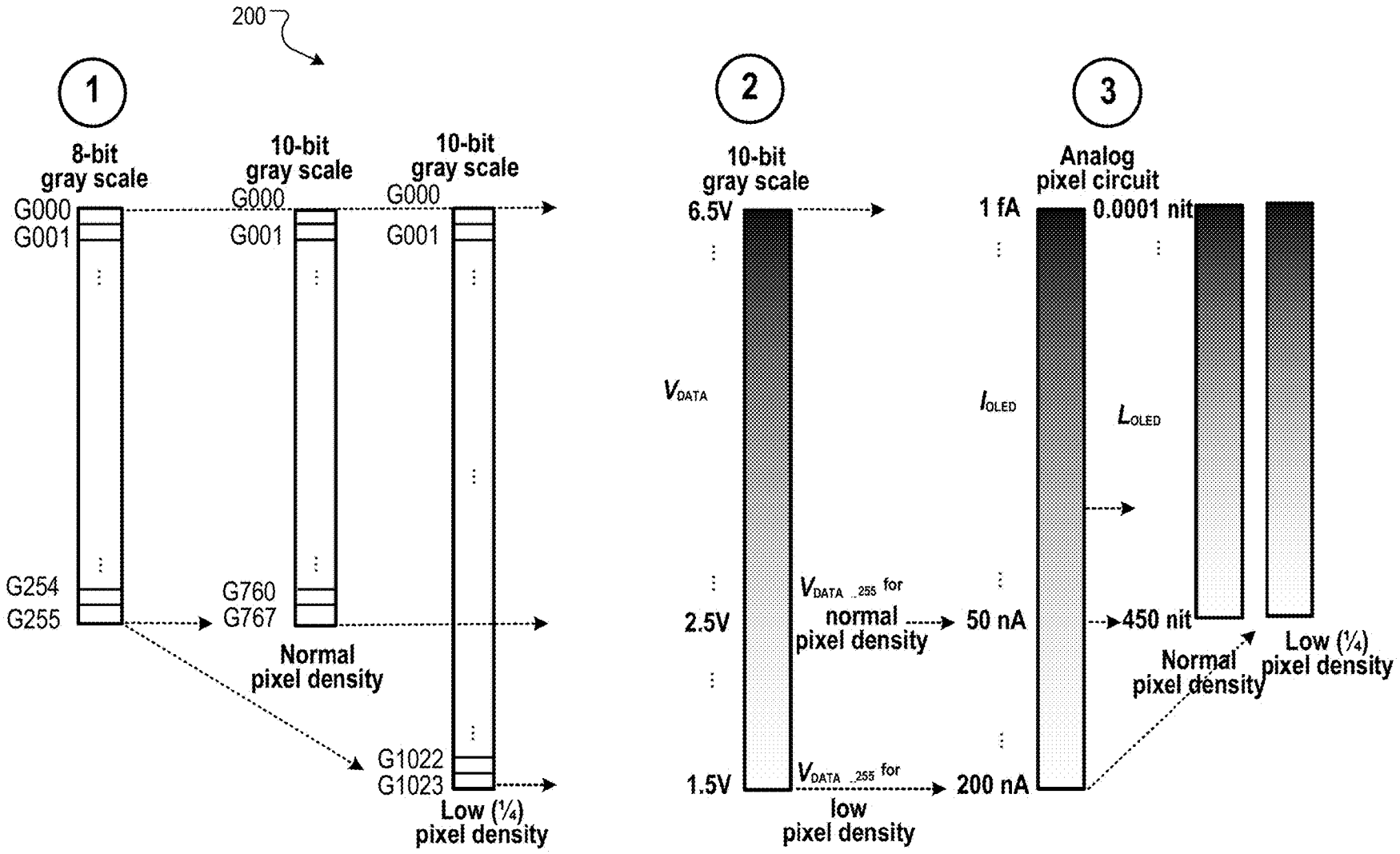
FIG. 2 is a visualization of locally different gamma mapping.

FIG. 2 is a visualization 200 of locally different gamma mapping. FIG. 2 may represent locally different gamma mapping based on the system 100 shown in FIG. 1. As shown in FIG. 2, a grayscale value of G255 for all pixels in a normal pixel density area, e.g., the second area 114, may be remapped by the gamma mapper 120 to G767 which results in the driver integrated circuit 130 providing 2.5 V to pixels which results in fifty nanoamps (nA) which results in four hundred fifty nit brightness. Additionally, as shown in FIG. 2, a grayscale value of G255 for all pixels in a quarter pixel density area, e.g., the first area 112, may be remapped by the gamma mapper 120 to G1023 which results in the driver integrated circuit 130 providing 1.5 V to pixels which results in four times higher pixel current, two hundred nanoamps (nA), which results in four hundred fifty nit brightness for the quarter pixel density area.

In some implementations, the gamma mapper 120 may generate remapped image content based on a same scale as the received image content. For example, the gamma mapper 120 may use the same 8-bit scale for image content and remapped image content but use different ranges for the different areas such that G255 is remapped to G191 for pixels in the second area 114 and remapped to G255 for pixels in the first area 112.

While the examples describe locally different gamma mapping on grayscale values, locally different gamma mapping may independently be applied to red, green, blue (RGB) values. For example, a grayscale value of G255 of red pixels in the second area 114 may be remapped as G767 while a grayscale value of G255 of blue pixels in the second area 114 may be remapped as G760 by a gamma mapper 120 by independent different look-up tables of each color.

Figure 3:
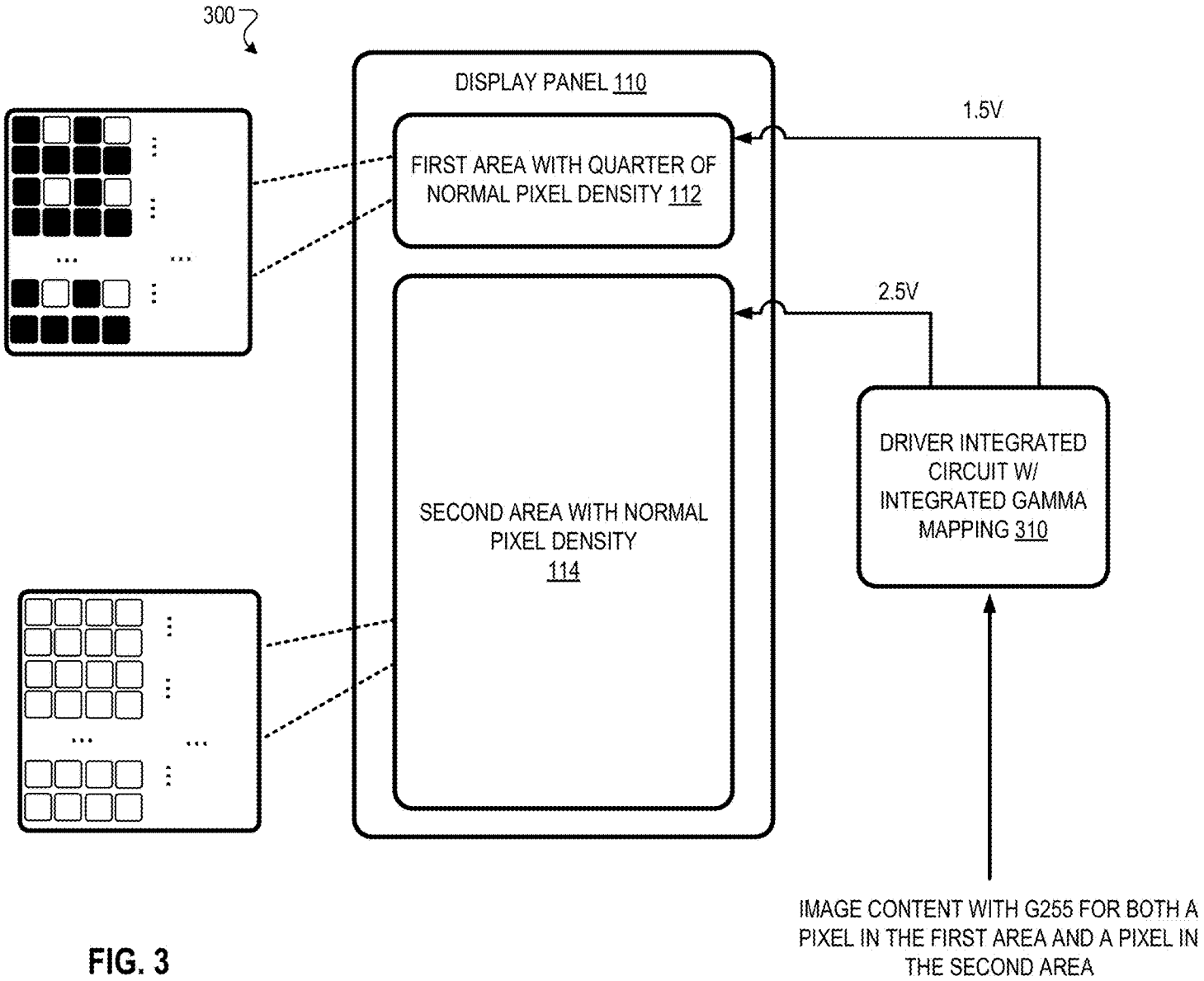
FIG. 3 is block diagram of another example system that includes a multi-pixel density OLED display using locally different gamma mapping.

FIG. 3 is block diagram of another example system 300 that includes a multi-pixel density OLED display 110 using locally different gamma mapping. The system 300 may be similar to the system 100 in using locally different gamma mapping and having the display panel 110 with a first area 112 with less pixel density than a second area 114. However, the system 300 may have gamma mapping integrated into the driver integrated circuit 310 instead of by a gamma mapper that is separate from the driver integrated circuit 310.

The driver integrated circuit 310 may receive image content and then provide voltages based on the image content and locally different gamma mapping. For example, the driver integrated circuit 310 may receive G255 for a first pixel in the first area 112, in response, provide 1.5 V, receive G255 for a second pixel in the second area 114, and, in response, provide 2.5 V. In another example, the driver integrated circuit 310 may receive G255 for a third pixel in the first area 112, in response, provide 1.5 V, receive G255 for a fourth pixel in the second area 114 and, in response, provide 2.5 V.

In some implementations, the driver integrated circuit 310 provides voltages on different ranges between the different areas. For example, the driver integrated circuit 310 may receive a digital grayscale value for pixels, determine a data voltage level for a pixel in the second area 114 based on the grayscale value in a range between 6.5 V and 2.5 V, and determine a data voltage level for a pixel in the first area 112 based on the grayscale value in a range between 6.5 V and 1.5 V (or a range between 6.3 V and 1.5 V).

In some implementations, the driver integrated circuit 310 may provide integrated gamma mapping through circuitry. For example, the driver integrated circuit 310 may include circuitry that receives grayscale values for pixels and outputs voltage differently based on the locations of the pixels in the display panel 110, where the circuitry is arranged based on which pixels are located in which of the first area 112 and the second area 114. In another implementation, the driver integrated circuit 310 may use a formula that receives a grayscale value for a pixel and a location of the pixel as a paired input, and outputs a voltage as output.

Figure 4A:
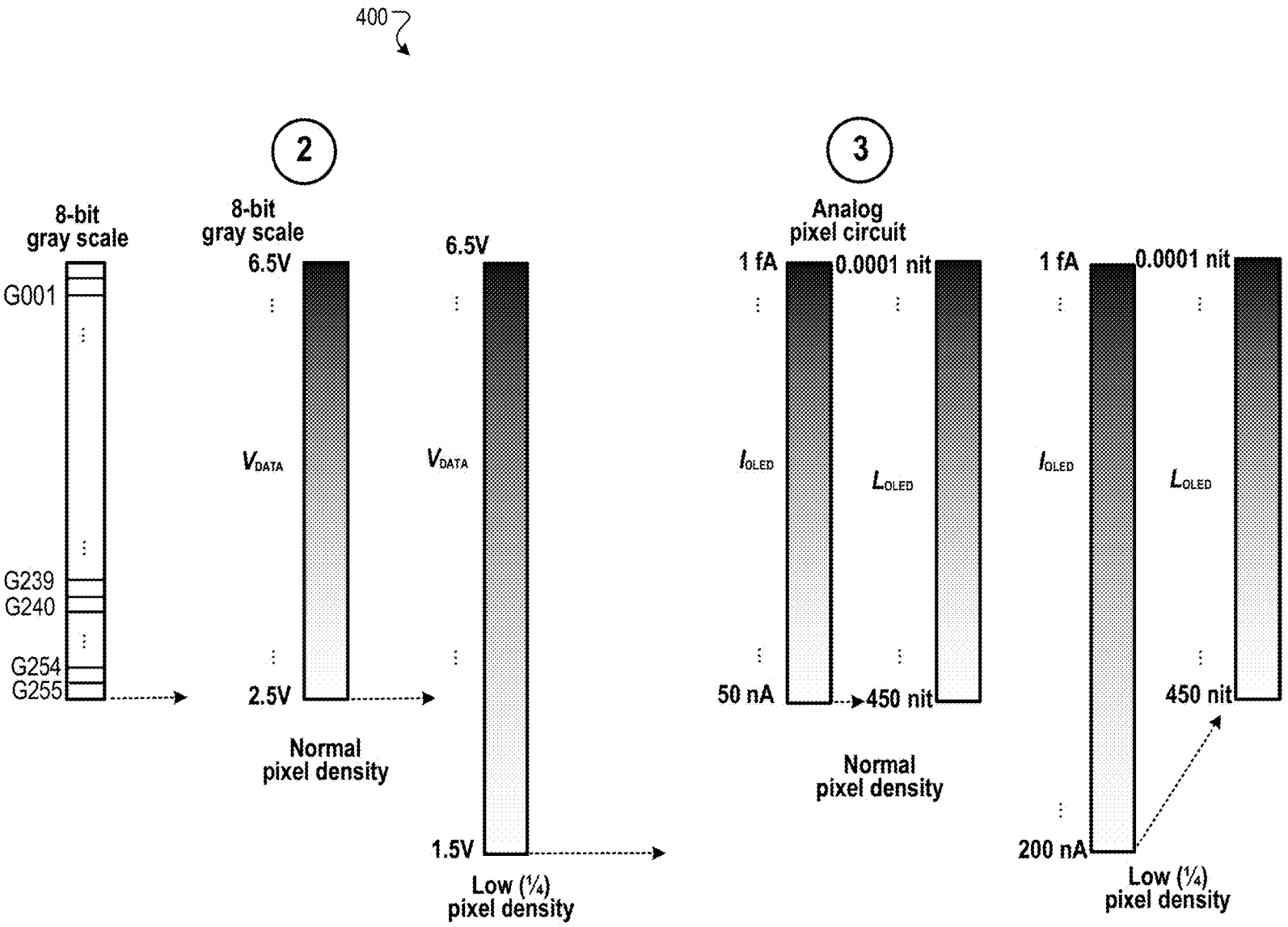
FIG. 4A is a visualization of locally different gamma mapping.

FIG. 4A is a visualization 400 of locally different gamma mapping. FIG. 4 may represent locally different gamma mapping based on the system 300 shown in FIG. 3. As shown in FIG. 4A, a grayscale value of G255 for all pixels in a normal pixel density area, e.g., the second area 114, may result in the driver integrated circuit 310 providing 2.5 V to pixels which results in fifty nanoamps (nA) of OLED pixel current and corresponding four hundred fifty nit brightness. Additionally, as shown in FIG. 4A, a grayscale value of G255 for all pixels in a quarter pixel density area, e.g., the first area 112, may result in the driver integrated circuit 310 providing 1.5 V to pixels which results in four times higher OLED pixel current, two hundred nanoamps (nA), and corresponding four hundred fifty nit brightness for the quarter pixel density area.

Figure 4B:
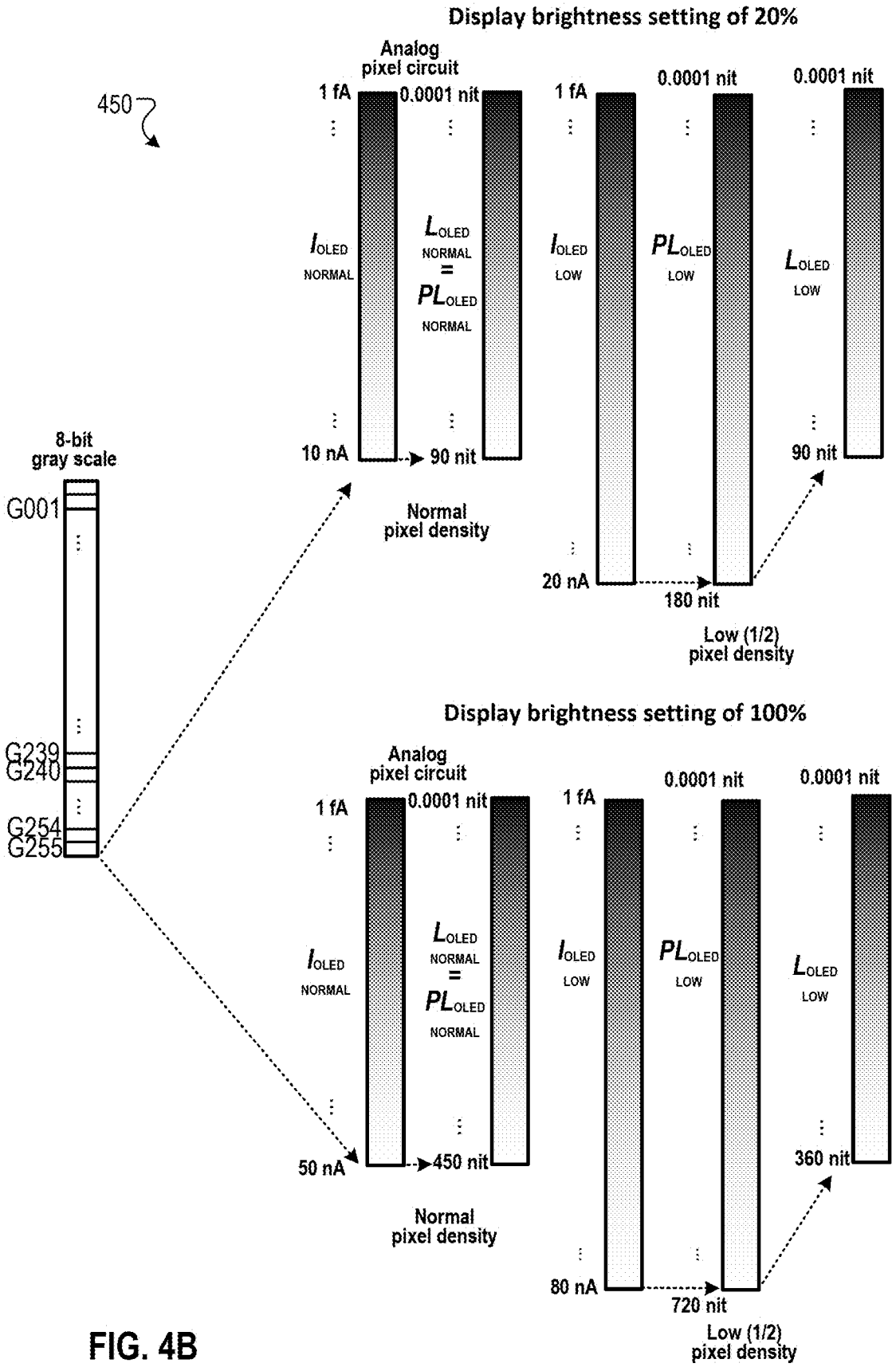
FIG. 4B is a visualization of adaptive locally different gamma mapping.

FIG. 4B is a visualization 450 of adaptive locally different gamma mapping. In some implementations, matching luminance between areas of the OLED displays that have different pixel densities may limit a maximum luminance of the displays. For example, at high display brightness settings a maximum brightness of pixels in the lower pixel density region may be insufficient to produce an overall luminance in the lower pixel density region that matches the luminance that could otherwise be produced in the higher pixel density region. Accordingly, the brightness of the pixels in the different pixel density areas may be further adaptively adjusted based on display brightness settings to increase a maximum luminance of the displays.

In FIG. 4B, $I_{OLED}$ NORMAL refers to current to a pixel in a normal pixel density area of the display, $L_{OLED\ NORMAL}$ refers to a unit area brightness of the normal pixel density area, $PL_{OLED\ NORMAL}$ refers to a luminance of a pixel in the normal pixel density area, $I_{OLED\ LOW}$ refers to current to a pixel in a low pixel density area of the display, $L_{OLED\ LOW}$ refers to a unit area brightness of the low pixel density area, $PL_{OLED\ LOW}$ refers to a luminance of a pixel in the low pixel density area.

A unit area brightness may refer to a perceived luminance for a unit area. For example, a group of four pixels in a two pixel size by two pixel size area may have a unit area brightness that is the same as the luminance of each pixel, and a group of two pixels in a two pixel size by two pixel size area may have a unit area brightness that is half the luminance of each pixel.

In the example shown in FIG. 4B, a multi-pixel density OLED display may have a maximum pixel brightness of seven hundred twenty nits and the pixels in the lower density area are half as dense as the pixels in the higher density area/the normal pixel density area. Accordingly, if the luminance of unit areas in the normal pixel density area and the lower density area were to always have matching unit area brightness, the unit area brightness of the normal pixel density area would be limited to three hundred sixty nits as the pixels in the lower density area may only be able to reach seventy hundred twenty nits per pixel to provide a unit area brightness of three hundred sixty nits.

With adaptive locally different gamma mapping, the normal pixel density area and the lower density area may have non-matching unit area brightness. For example, as shown in FIG. 4B, for the value of G255 and a display brightness setting of 100%, the normal pixel density area may have a unit area brightness of four hundred fifty nits and the lower density area may have a unit area brightness of three hundred sixty nits. In another example, for the value of G254 and a display brightness setting of 100%, the normal pixel density area may have a unit area brightness of four hundred forty seven nits and the lower density area may have a unit area brightness of three hundred fifty eight nits.

Display brightness setting may be a global setting for a brightness of a display, and may also be referred to as a brightness setting. For example, a user may set a display brightness setting of a device that includes the display to 0% while the user is using the device in the dark, then set the display brightness setting of a device to 50% while the user is using the device under a lamp, and then set the display brightness setting of a device to 100% while the user is using the device under a lamp.

The display brightness may control a brightness that images are displayed on the display. For example, G255 may be displayed in a normal pixel density area with ninety nits at 20% display brightness setting and displayed in a normal pixel density area with four hundred fifty nits at 100% display brightness setting. Similarly, G254 may be displayed in a normal pixel density area with eighty nine nits at 20% display brightness setting and displayed in a normal pixel density area with four hundred forty eight nits at 100% display brightness setting.

Adaptive locally different gamma mapping may have unit area brightnesses of the low pixel density area and the normal pixel density area match or not match based on a brightness setting of the display brightness. For example, adaptive locally different gamma mapping may have unit area brightnesses of the low pixel density area and the normal pixel density area match for a brightness setting of 50%. In another example, adaptive locally different gamma mapping may have unit area brightnesses of the low pixel density area and the normal pixel density area not match for a brightness setting of 90%

Adaptive locally different gamma mapping may be implemented within a gamma mapper separate from a driver integrated circuit or within a driver integrated circuit with integrated gamma mapping. For example, the gamma mapper 120 of FIG. 1 or the driver integrated circuit 310 of FIG. 3 with integrated gamma mapping may have different gamma lookup tables for the normal pixel density area for different display brightness settings, and have different gamma lookup tables for the normal pixel density area for different display brightness settings.

The gamma lookup tables for brightness settings that do satisfy the criteria may result in a unit area brightness in the low pixel density area that is less than the unit area brightness of the low pixel density area. For example, for a criteria of 80% or brighter, each pair of gamma lookup tables for the low pixel density area and the normal pixel density area for brightness settings from 80% to 100% may result in a unit area brightness in the low pixel density area that is less than the unit area brightness in normal pixel density area. The gamma lookup tables for brightness settings that do not satisfy the criteria may result in a unit area brightness in the low pixel density area that is equal to the unit area brightness of the low pixel density area. For example, for a criteria of 80% or brighter, each pair of gamma lookup tables for the low pixel density area and the normal pixel density area for brightness settings from 0% to 79% may result in a unit area brightness in the low pixel density area that is equal to the unit area brightness in the normal pixel density area.

Figure 5:
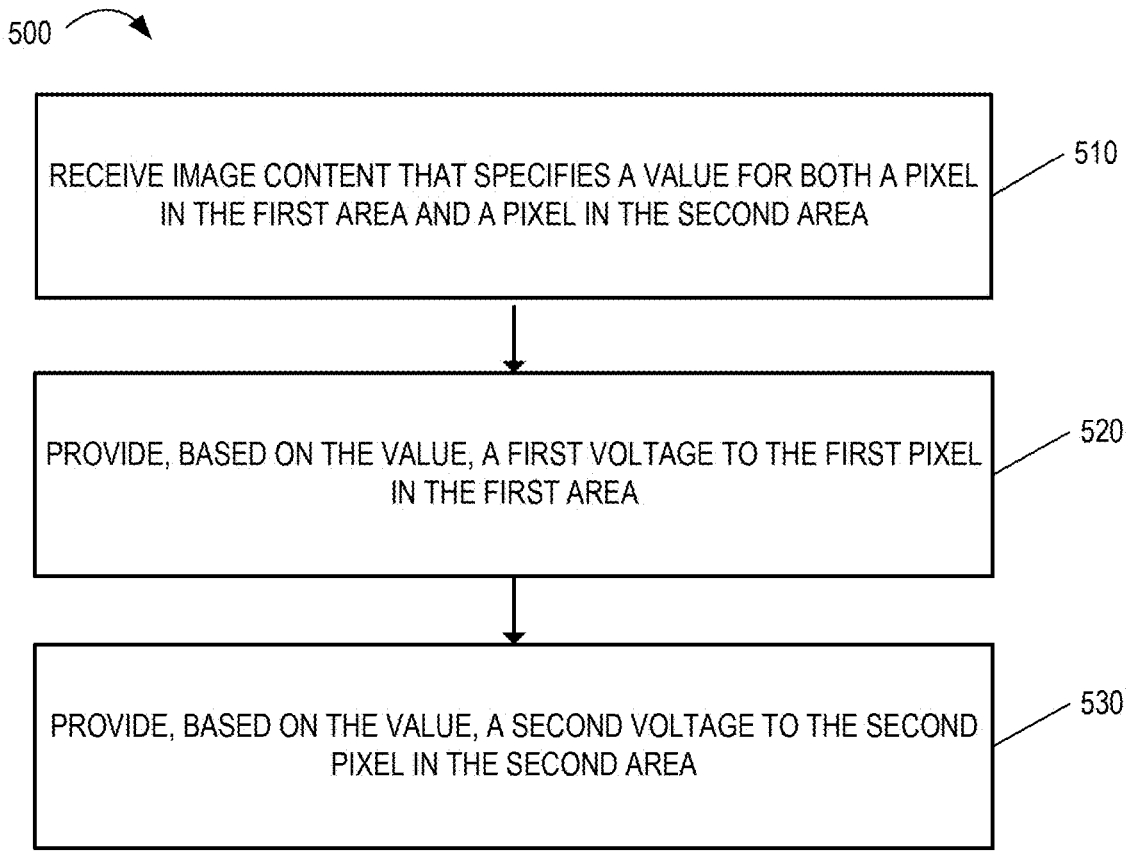
FIG. 5 is a flowchart that shows a process for locally different gamma mapping.

FIG. 5 is a flowchart that shows a process 500 for locally different gamma mapping. The process 500 may be performed by the system 100 or the system 300. The process 500 includes receiving image content that specifies a grayscale value for both a pixel in the first area and a pixel in the second area (510). For example, the gamma mapper 120 may receive image content that specifies G255 for all pixels in the display panel 110. In another example, the driver integrated circuit 310 may receive image content that specifies G255 for all pixels in the display panel 110.

The process 500 includes providing, based on the grayscale value, a first voltage to the first pixel in the first area (520). For example, the driver integrated circuit 130 may provide a voltage of 1.5 V for the first pixel in the first area 112.

In some implementations, providing, based on the grayscale value, a first voltage to the first pixel in the first area includes providing the first voltage to the first pixel in the first area, where the first voltage results in the first area having a unit area brightness that is less than a unit area brightness of the second area and a brightness setting for the display satisfies a criteria. For example, as shown in FIG. 4B, for a value of G255 and a display brightness setting of 100%, a voltage may be provided to a pixel in a lower density area that results in a unit area brightness of three hundred sixty nits which is less than a unit area brightness of four hundred fifty nits for a unit area brightness of a normal pixel density area for a same value of G255.

In some implementations, providing, based on the grayscale value, a first voltage to the first pixel in the first area includes providing the first voltage to the first pixel in the first area, where the first voltage results in the first area having a unit area brightness that is similar to a unit area brightness of the second area and a brightness setting for the display does not satisfy a criteria. For example, as shown in FIG. 4B, for a value of G255 and a display brightness setting of 20%, a voltage may be provided to a pixel in a lower density area that results in a unit area brightness of ninety nits which is the same unit area brightness of ninety nits for a unit area brightness of a normal pixel density area for a same value of G255.

The process 500 includes providing, based on the grayscale value, a second voltage to the second pixel in the second area (530). For example, the driver integrated circuit 130 may provide a voltage of 2.5 V for the second pixel in the second area 114.

In some implementations, providing, based on the grayscale value, a second voltage that is different from the first voltage to the second pixel in the second area includes determining a remapped grayscale value for the second pixel based on the grayscale value and providing the second voltage based on the remapped grayscale value. For example, the gamma mapper 120 may determine a remapped grayscale value of G767 based on the grayscale value of G255 and the driver integrated circuit 130 may provide a voltage of 2.5 V based on the remapped grayscale value of G767.

In some implementations, determining a remapped grayscale value for the second pixel based on the grayscale value includes determining that a location of the second pixel is within the second area and, in response to determining that the location of the second pixel is within the second area, determining the remapped grayscale value for the second pixel based on the grayscale value and a lookup table for the second area. For example, the gamma mapper 120 may determine that the second pixel is within the second area 114 and, in response, determine the remapped grayscale value of G767 based on a lookup table for the second area 114 that maps G255 to G767.

In some implementations, providing, based on the grayscale value, a first voltage to the first pixel in the first area includes determining that a location of the first pixel is within the first area and in response to determining that the location of the first pixel is within the first area, determining a remapped grayscale value for the first pixel based on the grayscale value and a lookup table for the first area. For example, the gamma mapper 120 may determine that the first pixel is within the first area 112 and, in response, determine the remapped grayscale value of G1023 based on a lookup table for the first area 112 that maps G255 to G1023.

In some implementations, providing the second voltage based on the remapped grayscale value includes providing the remapped grayscale value to a driver integrated circuit and providing, by the driver integrated circuit, the second voltage to the second pixel, where the driver integrated circuit is configured to output voltages in response to grayscale values that are input irrespective of locations of pixels that are driven by the voltages output. For example, the gamma mapper 120 may provide the remapped grayscale value of G767 to the driver integrated circuit 130 that provides a voltage of 2.5 V any time the driver integrated circuit 130 receives an input of G767.

In some implementations, the remapped grayscale value is a 10-bit value and the grayscale value is an 8-bit value. For example, the gamma mapper 120 may receive values represented in 8-bits and output remapped values represented in 10-bits.

In some implementations, providing, based on the grayscale value, a second voltage that is different from the first voltage to the second pixel in the second area includes receiving, by a driver integrated circuit, the grayscale value for the second pixel and providing, by the driver integrated circuit to the second pixel, the second voltage based on both the grayscale value and the second pixel being in the second area. In the implementation, providing, based on the grayscale value, a first voltage to the first pixel in the first area may also include receiving, by the driver integrated circuit, the grayscale value for the first pixel and providing, by the driver integrated circuit to the first pixel, the first voltage based on both the grayscale value and the first pixel being in the first area. For example, the driver integrated circuit 310 may receive a grayscale value of G255 for both a pixel in the first area 112 and a pixel in the second area 114 and, in response, provide a grayscale value of 2.5 V to the pixel in the second area 114 and a grayscale value of 1.5 V to the pixel in the first area 112.

In some implementations, actions include receiving second image content that also specifies the grayscale value for the first pixel in the first area and providing a third voltage that is different than the first voltage to the first pixel in the first area and the brightness setting for the display does not satisfy the criteria. For example, the display brightness setting may be changed from 100% to 20% and, for the same value of G255, a lower pixel density area may be provided a lower voltage.

Embodiments of the subject matter and the operations described in this specification can be implemented in digital electronic circuitry, or in computer software, firmware, or hardware, including the structures disclosed in this specification and their structural equivalents, or in combinations of one or more of them. Embodiments of the subject matter described in this specification can be implemented as one or more computer programs, i.e., one or more modules of computer program instructions, encoded on computer storage medium for execution by, or to control the operation of, data processing apparatus.

A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate physical components or media (e.g., multiple CDs, disks, or other storage devices).

The operations described in this specification can be implemented as operations performed by a data processing apparatus on data stored on one or more computer-readable storage devices or received from other sources.

The term "data processing apparatus" encompasses all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a standalone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., a FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few. Devices suitable for storing computer program instructions and data include all forms of non-volatile memory, media and memory devices, including by way of example semiconductor memory devices, e.g., EPROM (erasable programmable read-only memory), EEPROM (electrically erasable programmable read-only memory), and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, embodiments of the subject matter described in this specification can be implemented on a computer having a display device, e.g., a CRT (cathode ray tube), LCD (liquid crystal display) or OLED (organic light emitting diode) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's user device in response to requests received from the web browser.

Embodiments of the subject matter described in this specification can be implemented in a computing system that includes a back-end component, e.g., as a data server, or that includes a middleware component, e.g., an application server, or that includes a front-end component, e.g., a user computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

The computing system can include users and servers. A user and server are generally remote from each other and typically interact through a communication network. The relationship of user and server arises by virtue of computer programs running on the respective computers and having a user-server relationship to each other. In some embodiments, a server transmits data (e.g., an HTML page) to a user device (e.g., for purposes of displaying data to and receiving user input from a user interacting with the user device). Data generated at the user device (e.g., a result of the user interaction) can be received from the user device at the server.

While this specification contains many specific implementation details, these should not be construed as limitations on the scope of any features or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed is:

1. A method for driving an organic light emitting diode (OLED) display having a first area with a first pixel density and a second area with a second pixel density higher than the first pixel density, the method comprising:

receiving image content that specifies a grayscale value for both a first pixel in the first area and a second pixel in the second area;

providing, based on the grayscale value, a first voltage to the first pixel in the first area; and providing, based on the grayscale value, a second voltage that is different from the first voltage to the second pixel in the second area, where the second voltage causes the second pixel to emit light less brightly than the first voltage causes the first pixel to emit light, wherein providing, based on the grayscale value, the second voltage that is different from the first voltage to the second pixel in the second area comprises:

determining a remapped grayscale value for the second pixel based on the grayscale value, wherein determining the remapped grayscale value for the second pixel based on the grayscale value comprises:

determining that a location of the second pixel is within the second area; and in response to determining that the location of the second pixel is within the second area, determining the remapped grayscale value for the second pixel based on the grayscale value and a lookup table for the second area; and providing the second voltage based on the remapped grayscale value.

2. The method of claim 1, wherein providing, based on the grayscale value, the first voltage to the first pixel in the first area comprises:

determining that a location of the first pixel is within the first area; and in response to determining that the location of the first pixel is within the first area, determining a remapped grayscale value for the first pixel based on the grayscale value and a lookup table for the first area.

3. A method for driving an organic light emitting diode (OLED) display having a first area with a first pixel density and a second area with a second pixel density higher than the first pixel density, the method comprising:

receiving image content that specifies a grayscale value for both a first pixel in the first area and a second pixel in the second area;

providing, based on the grayscale value, a first voltage to the first pixel in the first area; and providing, based on the grayscale value, a second voltage that is different from the first voltage to the second pixel in the second area, where the second voltage causes the second pixel to emit light less brightly than the first voltage causes the first pixel to emit light, wherein providing, based on the grayscale value, the second voltage that is different from the first voltage to the second pixel in the second area comprises:

determining a remapped grayscale value for the second pixel based on the grayscale value; and providing the second voltage based on the remapped grayscale value, wherein providing the second voltage based on the remapped grayscale value comprises:

providing the remapped grayscale value to a driver integrated circuit; and providing, by the driver integrated circuit, the second voltage to the second pixel, where the driver integrated circuit is configured to output voltages in response to grayscale values that are input irrespective of locations of pixels that are driven by the voltages output.

4. The method of claim 1, wherein the number of digital bits for the remapped grayscale value is higher than or equal to grayscale bit numbers for the grayscale value.

5. The method of claim 1, wherein providing, based on the grayscale value, the second voltage that is different from the first voltage to the second pixel in the second area comprises:

receiving, by a driver integrated circuit, the grayscale value for the second pixel; and providing, by the driver integrated circuit to the second pixel, the second voltage based on both the grayscale value and the second pixel being in the second area.

6. The method of claim 3, wherein providing, based on the grayscale value, the first voltage to the first pixel in the first area comprises:

receiving, by the driver integrated circuit, the grayscale value for the first pixel; and providing, by the driver integrated circuit to the first pixel, the first voltage based on both the grayscale value and the first pixel being in the first area.

7. The method of claim 1, wherein providing, based on the grayscale value, the first voltage to the first pixel in the first area comprises:

providing the first voltage to the first pixel in the first area where the first voltage results in the first area having a unit area brightness that is less than a unit area brightness of the second area and a brightness setting for the display satisfies a criteria.

8. The method of claim 7, comprising:

receiving second image content that also specifies the grayscale value for the first pixel in the first area; and providing a third voltage that is different than the first voltage to the first pixel in the first area and the brightness setting for the display does not satisfy the criteria.

9. The method of claim 1, wherein providing, based on the grayscale value, the first voltage to the first pixel in the first area comprises:

providing the first voltage to the first pixel in the first area where the first voltage results in the first area having a unit area brightness that is similar to a unit area brightness of the second area and a brightness setting for the display does not satisfy a criteria.

10. A system comprising:

an organic light emitting diode (OLED) display having a first area with a first pixel density and a second area with a second pixel density higher than the first pixel density; and circuitry configured to perform the operations of:

receiving image content that specifies a grayscale value for both a first pixel in the first area and a second pixel in the second area;

providing, based on the grayscale value, a first voltage to the first pixel in the first area; and providing, based on the grayscale value, a second voltage that is different from the first voltage to the second pixel in the second area, where the second voltage causes the second pixel to emit light less brightly than the first voltage causes the first pixel to emit light, wherein providing, based on the grayscale value, the second voltage that is different from the first voltage to the second pixel in the second area comprises:

determining a remapped grayscale value for the second pixel based on the grayscale value, wherein determining the remapped grayscale value for the second pixel based on the grayscale value comprises:

determining that a location of the second pixel is within the second area; and in response to determining that the location of the second pixel is within the second area, determining the remapped grayscale value for the second pixel based on the grayscale value and a lookup table for the second area; and providing the second voltage based on the remapped grayscale value.

11. The system of claim 10, wherein providing, based on the grayscale value, the first voltage to the first pixel in the first area comprises:

determining that a location of the first pixel is within the first area; and in response to determining that the location of the first pixel is within the first area, determining a remapped grayscale value for the first pixel based on the grayscale value and a lookup table for the first area.

12. The system of claim 10, wherein providing the second voltage based on the remapped grayscale value comprises:

providing the remapped grayscale value to a driver integrated circuit; and providing, by the driver integrated circuit, the second voltage to the second pixel, where the driver integrated circuit is configured to output voltages in response to grayscale values that are input irrespective of locations of pixels that are driven by the voltages output.

13. The system of claim 10, wherein providing, based on the grayscale value, the first voltage to the first pixel in the first area comprises:

providing the first voltage to the first pixel in the first area where the first voltage results in the first area having a unit area brightness that is less than a unit area brightness of the second area and a brightness setting for the display satisfies a criteria.

14. The system of claim 13, the operations comprising:

receiving second image content that also specifies the grayscale value for the first pixel in the first area; and providing a third voltage that is different than the first voltage to the first pixel in the first area and the brightness setting for the display does not satisfy the criteria.

15. The system of claim 10, wherein providing, based on the grayscale value, a first voltage to the first pixel in the first area comprises:

providing the first voltage to the first pixel in the first area where the first voltage results in the first area having a unit area brightness that is similar to a unit area brightness of the second area and a brightness setting for the display does not satisfy a criteria.

16. A non-transitory computer-readable medium storing software comprising instructions executable by one or more computers which, upon such execution, cause the one or more computers to perform operations for driving an organic light emitting diode (OLED) display having a first area with a first pixel density and a second area with a second pixel density higher than the first pixel density, the operations comprising:

receiving image content that specifies a grayscale value for both a first pixel in the first area and a second pixel in the second area;

providing, based on the grayscale value, a first voltage to the first pixel in the first area; and providing, based on the grayscale value, a second voltage that is different from the first voltage to the second pixel in the second area, where the second voltage causes the second pixel to emit light less brightly than the first voltage causes the first pixel to emit light, wherein providing, based on the grayscale value, the second voltage that is different from the first voltage to the second pixel in the second area comprises:

determining a remapped grayscale value for the second pixel based on the grayscale value; and providing the second voltage based on the remapped grayscale value, wherein providing the second voltage based on the remapped grayscale value comprises:

providing the remapped grayscale value to a driver integrated circuit; and providing, by the driver integrated circuit, the second voltage to the second pixel, where the driver integrated circuit is configured to output voltages in response to grayscale values that are input irrespective of locations of pixels that are driven by the voltages output.

17. A method for driving an organic light emitting diode (OLED) display having a first area with a first pixel density and a second area with a second pixel density higher than the first pixel density, the method comprising:

receiving image content that specifies a grayscale value for both a first pixel in the first area and a second pixel in the second area;

providing, based on the grayscale value, a first voltage to the first pixel in the first area; and providing, based on the grayscale value, a second voltage that is different from the first voltage to the second pixel in the second area, where the second voltage causes the second pixel to emit light less brightly than the first voltage causes the first pixel to emit light, wherein providing, based on the grayscale value, the first voltage to the first pixel in the first area comprises:

providing the first voltage to the first pixel in the first area where the first voltage results in the first area having a unit area brightness that is less than a unit area brightness of the second area when a brightness setting for the display is higher than a threshold value; and providing the first voltage to the first pixel in the first area where the first voltage results in the first area having a unit area brightness that is similar to a unit area brightness of the second area when the brightness setting for the display is lower than the threshold value.

* * * * *